US011460227B2

(12) United States Patent
Kato et al.

(10) Patent No.: US 11,460,227 B2
(45) Date of Patent: Oct. 4, 2022

(54) OIL SEPARATOR AND REFRIGERATION CYCLE APPARATUS

(71) Applicant: Mitsubishi Electric Corporation, Tokyo (JP)

(72) Inventors: Shun Kato, Tokyo (JP); Hiroki Ishiyama, Tokyo (JP); Yusuke Shimazu, Tokyo (JP); Daisuke Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 192 days.

(21) Appl. No.: 16/763,123

(22) PCT Filed: Nov. 15, 2017

(86) PCT No.: PCT/JP2017/041130
§ 371 (c)(1),
(2) Date: May 11, 2020

(87) PCT Pub. No.: WO2019/097612
PCT Pub. Date: May 23, 2019

(65) Prior Publication Data

US 2020/0292220 A1 Sep. 17, 2020

(51) Int. Cl.
*F25B 31/00* (2006.01)
*F25B 33/00* (2006.01)
(Continued)

(52) U.S. Cl.
CPC ..... *F25B 31/004* (2013.01); *F25B 33/00* (2013.01); *F25B 41/20* (2021.01); *F25B 43/003* (2013.01);
(Continued)

(58) Field of Classification Search
CPC ..... F25B 43/02; F25B 31/004; F25B 41/20; F25B 41/40; F25B 43/003; F25B 2500/16;
(Continued)

(56) References Cited

U.S. PATENT DOCUMENTS 1,948,572 A * 2/1934 Floyd ..... F25B 31/004 62/193
4,418,548 A * 12/1983 Sawyer ..... F25B 49/022 137/513.7
(Continued)

FOREIGN PATENT DOCUMENTS

CN 104204692 A 12/2014
JP S56-170664 U 12/1981
JP 2004-092933 A 3/2004

OTHER PUBLICATIONS

Chinese Office Action dated Apr. 8, 2021, issued in corresponding CN Patent Application No. 201780096593.8 (and English Machine Translation).
(Continued)

*Primary Examiner* — Kun Kai Ma
(74) *Attorney, Agent, or Firm* — Posz Law Group, PLC

(57) ABSTRACT

An oil separator has a filter portion in a differential pressure generation mechanism configured to collect, by a differential pressure, lubricating oil that is in a form of mist included in high-pressure refrigerant that flows in a first pipe that is connected to a discharge port of a compressor and allows the collected lubricating oil to move downstream along an internal wall of the first pipe.

10 Claims, 4 Drawing Sheets

(51) Int. Cl.

| | |
|---|---|
| ***F25B 43/00*** | (2006.01) |
| ***F25B 43/02*** | (2006.01) |
| ***F25B 41/20*** | (2021.01) |
| ***F25B 39/02*** | (2006.01) |

(52) U.S. Cl.
CPC ..... *F25B 43/02* (2013.01); *F25B 39/02* (2013.01); *F25B 2500/16* (2013.01); *F25B 2600/2515* (2013.01)

(58) Field of Classification Search
CPC ... F25B 2600/2515; F25B 39/02; F25B 49/02
See application file for complete search history.

(56) References Cited

U.S. PATENT DOCUMENTS 4,506,523 A * 3/1985 DiCarlo ..... F04B 39/16 62/470
4,530,215 A * 7/1985 Kramer ..... F25B 31/002 62/468
4,750,337 A * 6/1988 Glamm ..... F04B 39/0207 62/468
5,199,271 A * 4/1993 Ewer ..... B64D 13/06 62/157
5,317,874 A * 6/1994 Penswick ..... F02G 1/043 60/517
5,553,460 A * 9/1996 Isaacs ..... B01D 45/16 62/129
5,839,886 A * 11/1998 Shaw ..... F25B 31/002 62/470
2002/0035839 A1* 3/2002 Sjoholm ..... F04C 29/0007 62/193
2010/0218522 A1* 9/2010 Cochran ..... F25B 31/004 62/115
2013/0255308 A1 10/2013 De Larminat
2014/0056725 A1* 2/2014 Fraser ..... F04C 28/02 417/53
2014/0130539 A1* 5/2014 Yoon ..... F25B 43/02 62/470
2016/0290693 A1* 10/2016 Pereira ..... F25B 9/008
2019/0178543 A1* 6/2019 McKim ..... F25B 31/002

OTHER PUBLICATIONS

International Search Report of the International Searching Authority mailed Jan. 30, 2018 for the corresponding International application No. PCT/JP2017/041130 (and English translation).
Extended European Search Report dated Sep. 9, 2020 issued in corresponding European patent application No. 17932092.4.

* cited by examiner

OIL SEPARATOR AND REFRIGERATION CYCLE APPARATUS

CROSS REFERENCE TO RELATED APPLICATION

This application is a U.S. national stage application of PCT/JP2017/041130 filed on Nov. 15, 2017, the contents of which are incorporated herein by reference.

TECHNICAL FIELD

The present disclosure relates to an oil separator for separating, from refrigerant, lubricating oil mixed with the refrigerant and a refrigeration cycle apparatus that includes the oil separator in a refrigeration cycle.

BACKGROUND ART

A refrigeration cycle apparatus provided with a refrigerant circuit includes a compressor as an element device. In the compressor, lubricating oil such as refrigerating machine oil is widely used to lubricate sliding parts in the shell. After the lubricating oil is mixed with the refrigerant in a compressor shell, the lubricating oil is disadvantageously discharged together with the refrigerant from the compressor. When the lubricating oil mixed in the refrigerant stays in an evaporator or a refrigerant pipe, performance of the evaporator decrease. Further, when the necessary amount of lubricating oil to be used to lubricate the sliding parts in the compressor shell is brought out of the compressor, seizure of the compressor may be thus caused.

Therefore, such a method has been used that an oil separator is installed in a refrigeration cycle of the refrigeration cycle apparatus, or an oil recovery device is located in the evaporator, and lubricating oil collected by the oil separator or the oil recovery device is returned to the compressor shell. However, as the oil separator or the oil recovery device has to be attached to the refrigeration cycle, a sufficient space for installing the oil separator or the oil recovery device is required. In addition, providing the oil separator or the oil recovery device may deteriorate performance of other devices located in the refrigeration cycle. Further, high cost will be required for the installation of the oil separator or the oil recovery device.

Therefore, as disclosed in Patent Literature 1, a refrigeration cycle separation tube has been known that has, "in a refrigeration cycle oil separator that has a double-pipe structure including an inner pipe and an outer pipe coaxially attached via a connection connector to a conduit through which gaseous refrigerant flows in the refrigeration cycle, the inner pipe is made of a porous body through which oil penetrate, and the inner pipe inserted with a gap inside the outer pipe in such a manner that a passage that extends in the axial direction of these pipes is formed between the inner pipe and the outer pipe".

CITATION LIST

Patent Literature

Patent Literature 1: Japanese Patent No. 56-170664

SUMMARY OF INVENTION

Technical Problem

The refrigeration cycle oil separator disclosed in Patent Literature 1 has the double-pipe structure in which the inner pipe whose wall portion has oil permeability is inserted with a gap in the outer pipe to form the passage that extends in the axial direction. Therefore, when the oil film is thick, in a direction from the center of the inner pipe to the wall of the inner pipe, the trapping of lubricating oil far from the wall is weak and the lubricating oil thus passes through the oil separation tube before the lubricating oil penetrates into the outer pipe. As a result, the separation efficiency decreases. On the other hand, when the oil film formed in the inner pipe is thin, or when no oil film is formed, the molecular diameter of the refrigerant gas is much smaller than the oil particle diameter. Therefore, the refrigerant flows from the inner pipe into the outer pipe, and the refrigerant flow rate decreases after the refrigerant passes through the oil separation tube, so that the entire performance of the refrigeration cycle decreases.

In view of the above-described problems, the present disclosure aims to provide an oil separator that is configured to prevent the reduction in separation efficiency with low piping pressure loss, and a refrigeration cycle apparatus provided with the oil separator.

Solution to Problem

An oil separator of an embodiment of the present disclosure has a first pipe connected to a discharge port of a compressor, and a second pipe connected to a suction port of the compressor. In addition, the oil separator has a differential pressure generation mechanism that has a third pipe that connects the first pipe and the second pipe with each other and a filter portion located at a distal end of the third pipe at which the third pipe is connected to the first pipe, and is configured to generate a differential pressure between a pressure of high-pressure refrigerant that flows in the first pipe and a pressure of low-pressure refrigerant that flows in the second pipe. The oil separator further has an oil return mechanism that has an oil return port opened and formed downstream of a connection position at which the third pipe is connected to the first pipe and a portion of an oil return circuit that connects the first pipe and the second pipe with each other via the oil return port, and is configured to return, via the oil return port and the oil return circuit, lubricating oil included in the high-pressure refrigerant from the first pipe to the second pipe. The filter portion in the differential pressure generation mechanism is configured to collect, by the differential pressure, the lubricating oil that is in a form of mist included in the high-pressure refrigerant. The first pipe allows the collected lubricating oil to move downstream along an internal wall of the first pipe.

Advantageous Effects of Invention

With the oil separator of an embodiment of the present disclosure, the differential pressure generated between the pressure of the high-pressure refrigerant that flows in the first pipe and the pressure of the low-pressure refrigerant that flows in the second pipe is used to collect the lubricating oil. Therefore, it is unnecessary to provide an obstacle inside the first pipe, and the piping pressure loss is thus greatly reduced. In addition, as the lubricating oil is separated irrespective of the oil droplet diameter, the reduction in separation efficiency is prevented.

DESCRIPTION OF EMBODIMENTS

Figure 1:
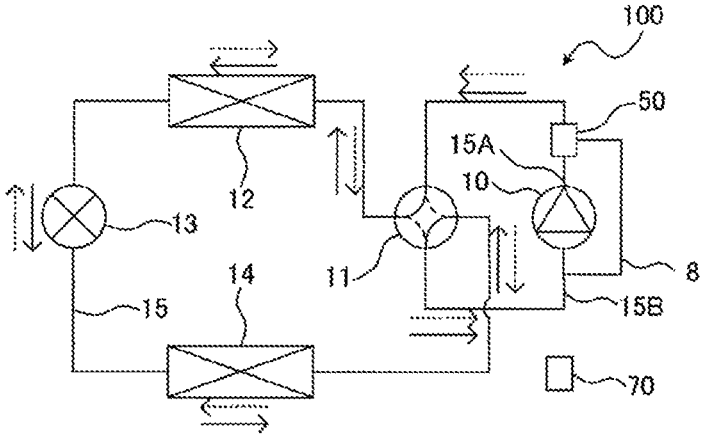
FIG. 1 is a schematic configuration diagram illustrating an exemplary refrigerant circuit configuration of a refrigeration cycle apparatus of Embodiment 1 of the present disclosure.

Hereinafter, some embodiments of the present disclosure will be described with reference to attached drawings. In the following drawings including FIG. 1, the relationship of sizes of the components in the drawings may differ from the actual sizes. In the following drawings including FIG. 1, those denoted by the same reference signs are the same or equivalent, and the reference signs are common throughout the entire description. Further, the forms of constituent components in the entire description are merely examples and the present disclosure is not limited to these descriptions.

Embodiment 1

FIG. 1 is a schematic configuration diagram illustrating an exemplary refrigerant circuit configuration of a refrigeration cycle apparatus 100 of Embodiment 1 of the present disclosure. The refrigeration cycle apparatus 100 illustrated in FIG. 1 is configured to switch the flows of refrigerant. In FIG. 1, solid arrows represent the flow of the refrigerant when a first heat exchanger 12 is used as a condenser and a second heat exchanger 14 is used as an evaporator, and dotted arrows represent the flow of the refrigerant when the first heat exchanger 12 is used as an evaporator and the second heat exchanger 14 is used as a condenser.

<Configuration of Refrigeration Cycle Apparatus 100>

As illustrated in FIG. 1, the refrigeration cycle apparatus 100 includes a refrigerant circuit that includes a compressor 10, a flow switching device 11, the first heat exchanger 12, a decompression device 13, and the second heat exchanger 14, which are connected via a refrigerant pipe 15. The refrigerant pipe 15 has a discharge pipe 15A that is connected to a discharge port of the compressor 10 and a suction pipe 15B that is connected to a suction port of the compressor 10.

The suction pipe 15B corresponds to a "second pipe" in the present disclosure.

An oil separator 50 is connected between the compressor 10 and the flow switching device 11, that is, at a portion of the refrigerant pipe that is connected to the discharge port of the compressor 10.

An example is illustrated in FIG. 1 in which the refrigeration cycle apparatus 100 in which the flow switching device 11 is provided and the flows of the refrigerant are switchable by the flow switching device 11; however, the flow of the refrigerant may be fixed without providing the flow switching device 11. In this case, the first heat exchanger 12 is used only as a condenser and the second heat exchanger 14 is used only as an evaporator.

The compressor 10, the oil separator 50, the flow switching device 11, the first heat exchanger 12, and the decompression device 13 are mounted on, for example, a heat-source unit. When the refrigeration cycle apparatus 100 is used as an air-conditioning apparatus, the heat-source unit is installed in a space different from an air-conditioned space, for example, outdoors, and supplies cooling energy or heating energy to a load unit.

The second heat exchanger 14 is mounted on, for example, on the load unit. When the refrigeration cycle apparatus 100 is used as an air-conditioning apparatus, the load unit is installed in a space that supplies cooling energy or heating energy to the air-conditioned space, for example, indoors, and cools or heats the air-conditioned space with the cooling energy or heating energy supplied from the heat-source unit.

The compressor 10 is configured to compress and discharge the refrigerant. Examples of the compressor 10 include a rotary compressor, a scroll compressor, a screw compressor, and a reciprocating compressor. When the first heat exchanger 12 is used as a condenser, the refrigerant discharged from the compressor 10 passes through the discharge pipe 15A and is sent to the first heat exchanger 12. When the first heat exchanger 12 is used as an evaporator, the refrigerant discharged from the compressor 10 passes through the discharge pipe 15A and is sent to the second heat exchanger 14.

The compressor 10 uses lubricating oil such as refrigerating machine oil to lubricate sliding parts in a shell of the compressor 10.

The flow switching device 11 is located at a portion of the refrigerant pipe that is connected to the discharge port of the compressor 10, more specifically, downstream of the oil separator 50, and is configured to switch the flows of the refrigerant between the heating operation and the cooling operation. Examples of the flow switching device 11 include a four-way valve, combination of three-way valves, and combination of two-way valves.

The first heat exchanger 12 is configured to operate as a condenser or an evaporator. The first heat exchanger 12 may be, for example, a fin-and-tube heat exchanger.

The first heat exchanger 12 is exposed to heat medium such as air, refrigerant, water, and brine in accordance with the intended use of the refrigeration cycle apparatus 100, and heat is thus exchanged between the heat medium and the refrigerant that flows in the refrigerant pipe 15.

The decompression device 13 is configured to decompress the refrigerant that has passed through the second heat exchanger 14 or the first heat exchanger 12. The decompression device 13 may be, for example, an electronic expansion valve or a capillary tube. The decompression device 13 may be mounted on the load unit instead of being mounted on the heat-source unit.

The second heat exchanger 14 is configured to operate as an evaporator or a condenser. The second heat exchanger 14 may be, for example, a fin-and-tube heat exchanger.

The second heat exchanger 14 is exposed to heat medium such as air, refrigerant, water, and brine in accordance with the intended use of the refrigeration cycle apparatus 100, and heat is thus exchanged between the heat medium and the refrigerant that flows in the refrigerant pipe 15.

The oil separator 50 is configured to separate, from the refrigerant, the lubricating oil discharged together with the refrigerant from the compressor 10. The lubricating oil separated by the oil separator 50 is guided to the suction port of the compressor 10 via an oil return circuit 8. The oil return circuit 8 is configured to connect the oil separator 50 and the suction pipe 15B.

The oil separator 50 will be described in detail with reference to FIG. 2 and the following drawings.

Further, the refrigeration cycle apparatus 100 includes a controller 70 that integrally controls the whole of the refrigeration cycle apparatus 100. The controller 70 controls the driving frequency of the compressor 10. Further, the controller 70 controls the opening degree of the decompression device 13 depending on the operation state. In addition, the controller 70 controls the opening degree and the closing degree of a flow control valve 7 described below and the opening degree and the closing degree of an oil return valve 9 described below.

Functional units of the controller 70 include dedicated hardware or a micro processing unit (MPU) that executes programs stored in a memory.

The controller 70 uses information transmitted from temperature sensors (not illustrated) and pressure sensors (not illustrated) and controls, in accordance with an operation instruction, an actuator such as the compressor 10, the decompression device 13, the flow control valve 7, and the oil return valve 9. Further, the controller 70 controls the driving of, for example, a fan that delivers the heat medium or a heat medium delivery device such as a pump in accordance with the intended use of the refrigeration cycle apparatus 100.

<Operation of Refrigeration Cycle Apparatus 100>

Next, operations of the refrigeration cycle apparatus 100 will be described together with the flow of the refrigerant. Here, operations of the refrigeration cycle apparatus 100 will be described with an example in which the heat exchanging fluid is air and the heat exchanged fluid is refrigerant.

First, an operation in which the first heat exchanger 12 is used as a condenser will be described.

When the compressor 10 is driven, the compressor 10 discharges high-temperature and high-pressure gaseous refrigerant. The refrigerant flows as represented by the solid arrows. The high-temperature and high-pressure gaseous refrigerant discharged from the compressor 10 flows through the discharge pipe 15A and flows into the first heat exchanger 12 via the oil separator 50 and the flow switching device 11. In the first heat exchanger 12, heat is exchanged between the high-temperature and high-pressure gaseous refrigerant, which has flowed into the first heat exchanger 12, and air supplied to the first heat exchanger 12, and the high-temperature and high-pressure gaseous refrigerant condenses into high-pressure liquid refrigerant.

The high-pressure liquid refrigerant delivered from the first heat exchanger 12 is turned into two-phase gas-liquid refrigerant of low-pressure gaseous refrigerant and liquid refrigerant by the decompression device 13. The two-phase gas-liquid refrigerant flows into the second heat exchanger 14, which operates as an evaporator. In the second heat exchanger 14, heat is exchanged between the two-phase gas-liquid refrigerant, which has flowed into the second heat exchanger 14, and air supplied to the second heat exchanger 14, and the liquid refrigerant evaporates from the two-phase gas-liquid refrigerant and becomes low-pressure gaseous refrigerant. The low-pressure gaseous refrigerant delivered from the second heat exchanger 14 flows through the suction pipe 15B via the flow switching device 11, and is suctioned and compressed by the compressor 10, and becomes high-temperature and high-pressure gaseous refrigerant, and is again discharged from the compressor 10. This cycle is repeated.

Next, an operation in which the first heat exchanger 12 is used as an evaporator will be described.

When the compressor 10 is driven, the compressor 10 discharges high-temperature and high-pressure gaseous refrigerant. The refrigerant flows as represented by dotted arrows. The high-temperature and high-pressure gaseous refrigerant discharged from the compressor 10 flows through the discharge pipe 15A and flows into the second heat exchanger 14 via the oil separator 50 and the flow switching device 11. In the second heat exchanger 14, heat is exchanged between the high-temperature and high-pressure gaseous refrigerant, which has flowed into the second heat exchanger 14, and air supplied to the second heat exchanger 14, and the high-temperature and high-pressure gaseous refrigerant condenses into high-pressure liquid refrigerant.

The high-pressure liquid refrigerant delivered from the second heat exchanger 14 is turned into two-phase gas-liquid refrigerant of low-pressure gaseous refrigerant and liquid refrigerant by the decompression device 13. The two-phase gas-liquid refrigerant flows into the first heat exchanger 12. In the first heat exchanger 12, heat is exchanged between the two-phase gas-liquid refrigerant, which has flowed into the first heat exchanger 12, and air supplied to the first heat exchanger 12, and the liquid refrigerant evaporates from the two-phase gas-liquid refrigerant and becomes low-pressure gaseous refrigerant. The low-pressure gaseous refrigerant delivered from the first heat exchanger 12 flows through the suction pipe 15B via the flow switching device 11, and is suctioned and compressed by the compressor 10, and becomes high-temperature and high-pressure gaseous refrigerant, and is again discharged from the compressor 10. This cycle is repeated.

Figure 2:
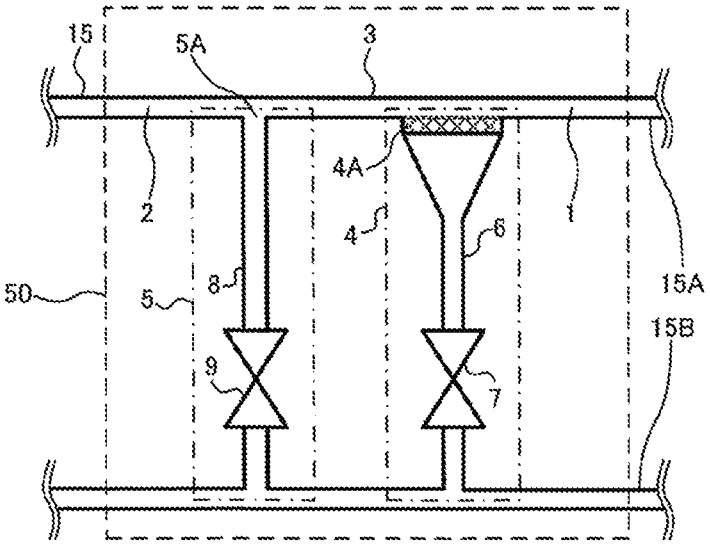
FIG. 2 is a schematic configuration diagram schematically illustrating an exemplary configuration of an oil separator of Embodiment 1 of the present disclosure.
Figure 3:
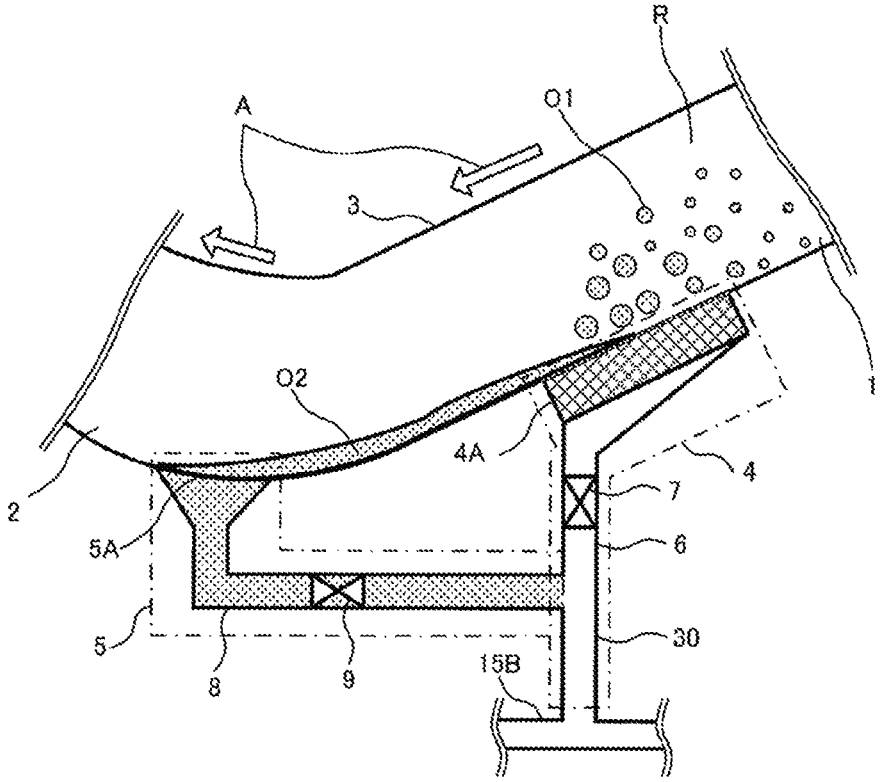
FIG. 3 is an explanatory diagram illustrating an operation of the oil separator of Embodiment 1 of the present disclosure.

FIG. 2 is a schematic configuration diagram schematically illustrating an exemplary configuration of the oil separator 50 of Embodiment 1 of the present disclosure. FIG. 3 is an explanatory diagram illustrating an operation of the oil separator 50. The configuration and operations of the oil separator 50 will be described with reference to FIGS. 2 and 3. In FIG. 3, arrows A represent the flow of the refrigerant. The oil separator 50 is installed, as one of the constituent components of the refrigeration cycle apparatus 100, in a refrigeration cycle of the refrigeration cycle apparatus 100. A state in which a connection pipe 3 is bent is illustrated in FIG. 3.

<Configuration of Oil Separator 50>

The oil separator 50 has an inflow pipe 1, an outflow pipe 2, the connection pipe 3, a differential pressure generation mechanism 4, and an oil return mechanism 5. The configuration in which the differential pressure generation mechanism 4 includes the flow control valve 7 is exemplarily illustrated in FIG. 2; however, the flow control valve 7 is not an essential component and may be located outside the differential pressure generation mechanism 4 and the oil separator 50. The configuration in which the oil return mechanism 5 includes the oil return valve 9 is exemplarily illustrated in FIG. 2; however, the oil return valve 9 is not an essential component and may be located outside the differential pressure generation mechanism 4 and the oil separator 50.

The inflow pipe 1 is connected to a pipe connected to the discharge port of the compressor 10, namely, the discharge pipe 15A, and is a pipe through which high-temperature and high-pressure refrigerant flows.

The outflow pipe 2 is connected to the flow switching device 11 and is a pipe through which the high-temperature and high-pressure refrigerant flows.

The connection pipe 3 is a pipe that is merged, at one end, into the inflow pipe 1 and, at the other end, into the outflow pipe 2. Therefore, the high-temperature and high-pressure refrigerant also flows in the connection pipe 3.

The inflow pipe 1 and the outflow pipe 2 are not pipes clearly separated from each other. With the differential pressure generation mechanism 4 as a boundary, a portion of the connection pipe 3 located upstream of the differential pressure generation mechanism 4 is simply referred to as the inflow pipe 1 and a portion of the connection pipe 3 located downstream of the differential pressure generation mechanism 4 is simply referred to as the outflow pipe 2.

The connection pipe 3 corresponds to a "first pipe" in the present disclosure.

The differential pressure generation mechanism 4 includes a high pressure-low pressure connection pipe 6 through which the connection pipe 3 and the suction pipe 15B communicate with each other and a filter portion 4A located at a distal end of the high pressure-low pressure connection pipe 6 at which the high pressure-low pressure connection pipe 6 is connected to the connection pipe 3. The differential pressure generation mechanism 4 generates a differential pressure between a pressure of the high-pressure refrigerant that flows in the connection pipe 3 and a pressure of the low-pressure refrigerant that flows in the suction pipe 15B.

The high pressure-low pressure connection pipe 6 corresponds to a "third pipe" in the present disclosure.

The connection pipe 3 communicates with the suction pipe 15B via the differential pressure generation mechanism 4. It is desired that an end portion of the differential pressure generation mechanism 4 at which the differential pressure generation mechanism 4 is connected to the connection pipe 3 is formed to have a substantially tapered shape in a side view in such a manner that the diameter of the differential pressure generation mechanism 4 increases toward the filter portion 4A, for example, as illustrated in FIG. 2. However, the shape of the differential pressure generation mechanism 4 is not limited to the illustrated shape.

The filter portion 4A is made of a porous material, and is configured to collect the lubricating oil that is in a form of mist into a liquid film. The filter portion 4A may be, for example, a demister. The filter portion 4A is located to be exposed inside the connection pipe 3. The differential pressure generation mechanism 4 is configured to draw the lubricating oil to the filter portion 4A and collect the lubricating oil as a liquid film by the differential pressure that generates when the connection pipe 3 and the suction pipe 15B communicate with each other.

The filter portion 4A may be fabricated integrally with the differential pressure generation mechanism 4 or may be fabricated separately from the differential pressure generation mechanism 4.

The high pressure-low pressure connection pipe 6 has one end connected to the connection pipe 3 and the other end connected to the suction pipe 15B.

The flow control valve 7 is located in the high pressure-low pressure connection pipe 6 and is configured to adjust the refrigerant flow rate by adjusting the opening degree and the closing degree of the flow control valve 7.

The oil return mechanism 5 includes an oil return port 5A that is opened and formed downstream of the connection position at which the high pressure-low pressure connection pipe 6 is connected to the connection pipe 3 and a portion of the oil return circuit 8 that connects the connection pipe 3 and the suction pipe 15B via the oil return port 5A. The oil return mechanism 5 is configured to return the lubricating oil, via the oil return port 5A and the oil return circuit 8, from the connection pipe 3 to the suction pipe 15B. That is, the oil return mechanism 5 returns the lubricating oil separated by the differential pressure generation mechanism 4 and collected by the filter portion 4A to the suction port of the compressor 10. The oil return port 5A is an inlet of the oil return circuit 8.

The oil return circuit 8 has one end connected to the connection pipe 3 and the other end connected to the suction pipe 15B.

The oil return valve 9 is located in the oil return circuit 8 and is configured to adjust the flow rate of lubricating oil by adjusting the opening degree and the closing degree of the oil return valve 9.

The configuration in which each of the high pressure-low pressure connection pipe 6 and the oil return circuit 8 is connected to the suction pipe 15B is exemplarily illustrated in FIG. 2; however, the connection portion at which the high pressure-low pressure connection pipe 6 and the suction pipe 15B are connected and the connection portion at which the oil return circuit 8 and the suction pipe 15B are connected may be commonly formed as a portion connected to the suction pipe 15B, as illustrated in FIG. 3. That is, a relay pipe 30 that is commonly used as the connection portion at which the high pressure-low pressure connection pipe 6 is connected to the suction pipe 15B and the connection portion at which the oil return circuit 8 is connected to the suction pipe 15B may be connected to the suction pipe 15B. The configuration in which a portion of the suction pipe 15B is incorporated in the oil separator 50 is exemplarily illustrated; however, the high pressure-low pressure connection pipe 6 and the oil return circuit 8 may be connected to a pipe that is different from the suction pipe 15B that is connected to the suction pipe 15B.

<Operation of Oil Separator 50>

Next, an operation of the oil separator 50 will be described.

As illustrated in FIG. 3, while the refrigeration cycle apparatus 100 is driven, both the refrigerant and the lubricating oil flow from the inflow pipe 1 into the oil separator 50 (as represented by the arrows A). At this time, the refrigerant is in a form of gas and the lubricating oil is in a form of mist. In FIG. 3, the gaseous refrigerant is illustrated as refrigerant R, the lubricating oil that is in a form of mist is illustrated as lubricating oil O1, and the lubricating oil formed by the collected lubricating oil O1 is illustrated as lubricating oil O2.

The inflow pipe 1, namely the connection pipe 3, is in communication with the high pressure-low pressure connection pipe 6 of the differential pressure generation mechanism 4. More specifically, the differential pressure generation mechanism 4 generates a differential pressure between a high pressure and a low pressure. This is because the inflow pipe 1 is in a high-pressure state because of the flow of the gaseous refrigerant discharged from the compressor 10 and the high pressure-low pressure connection pipe 6 is in a low-pressure state because of the flow of the gaseous refrigerant that returns to the compressor 10. For the purpose of using these two pressure states, the differential pressure generation mechanism 4 is located, and the differential pressure is thus generated with the differential pressure generation mechanism 4. The generation of the differential pressure causes the refrigerant and the lubricating oil to flow from the high-pressure portion to the low-pressure portion, that is, from the inflow pipe 1 to the high pressure-low pressure connection pipe 6. In other words, as illustrated in FIG. 3, the lubricating oil O1 is drawn to the filter portion 4A.

However, the filter portion 4A in the differential pressure generation mechanism 4 prevents the lubricating oil O1 from flowing into the high pressure-low pressure connection pipe 6. Therefore, the lubricating oil O1 is collected by the filter portion 4A. That is, the filter portion 4A in the differential pressure generation mechanism 4 acts to collect the lubricating oil O1 into a liquid film of the lubricating oil O2 while the differential pressure generation mechanism 4 acts to prevent the lubricating oil O1 from being guided into the high pressure-low pressure connection pipe 6. For example, when the filter portion 4A is a demister, the lubricating oil O1 is collected into the lubricating oil O2 because of the surface tension of the demister. The lubricating oil O2 forms an oil film and flows along an inner wall surface of the connection pipe 3 in the direction of gravity.

Subsequently, the lubricating oil O2 is guided to the oil return circuit 8 through the oil return port 5A of the oil return mechanism 5. That is, the lubricating oil O1 that is in a form of mist is collected as the lubricating oil O2. On the other hand, the refrigerant R from which the lubricating oil has been separated flows through the outflow pipe 2 and flows out of the oil separator 50.

In the differential pressure generation mechanism 4, a small amount of refrigerant gas and fine oil mist flow into the high pressure-low pressure connection pipe 6. The small amount of refrigerant gas and the fine oil mist, which has flowed into the high pressure-low pressure connection pipe 6, are guided to the suction port of the compressor 10. In addition, the lubricating oil that has flowed into the oil return circuit 8 via the oil return mechanism 5 is guided to the suction port of the compressor 10.

The case in which the lubricating oil O2 flows along the inner wall surface of the connection pipe 3 in the direction of gravity is exemplarily illustrated in FIG. 3; however, the lubricating oil O2 collected by the filter portion 4A is only required to be moved downstream along an internal wall of the connection pipe 3 and to be guided to the oil return port 5A.

<Effects Exerted by Oil Separator 50 and Refrigeration Cycle Apparatus 100>

Next, effects exerted by the oil separator 50 and the refrigeration cycle apparatus 100 will be described.

With the oil separator 50, it is possible to reduce the piping pressure loss of the refrigerant that passes through the connection pipe 3. That is, with the oil separator 50, the lubricating oil is collected by using the high-pressure state and the low-pressure state that are present the refrigerant circuit, without providing any obstacle against the flow of the refrigerant inside the connection pipe 3. Therefore, the piping pressure loss in the connection pipe 3 is greatly reduced.

Further, in a filter oil separator or a cyclone oil separator, which has been widely used, there is a problem in that the separation efficiency decreases when the oil mist has a fine oil droplet diameter. On the other hand, the oil separator 50 is configured to separate the lubricating oil irrespective of the oil droplet diameter. Therefore, with the refrigeration cycle apparatus 100 provided with the oil separator 50, it is possible to prevent the reduction in separation efficiency irrespective of the oil droplet diameter. And also, it is possible to reduce the oil that flows into the heat exchanger, for example, the first heat exchanger 12 or the second heat exchanger 14.

Further, in a refrigeration cycle apparatus that has a heat-source unit that is restricted in installation space, there is a problem in that it is difficult to locate an oil separator that requires a space, for example, a cyclone oil separator. In contrast, the refrigeration cycle apparatus 100 provided with the oil separator 50 is allowed to be installed without requiring a large space, and high separation efficiency is expected.

Further, as the refrigeration cycle apparatus 100 provided with the oil separator 50 is configured to reduce the amount of lubricating oil that flows into the heat exchanger, it is possible to reduce the reduction in heat transfer performance that may be caused when a heat transfer tube wall of the heat exchanger is covered by the lubricating oil, which has flowed into the heat exchanger. Therefore, the refrigeration cycle apparatus 100 is configured to prevent the increase in condensing pressure in a heat exchanger that is used as a condenser.

Further, with the refrigeration cycle apparatus 100 provided with the oil separator 50, it is possible to reduce the piping pressure loss. Therefore, reduction in compressor input is expected. That is, the refrigeration cycle apparatus 100 is configured to improve the coefficient of performance (COP) of the system by reducing the compressor input.

<Modification of Oil Separator 50>

Figure 4:
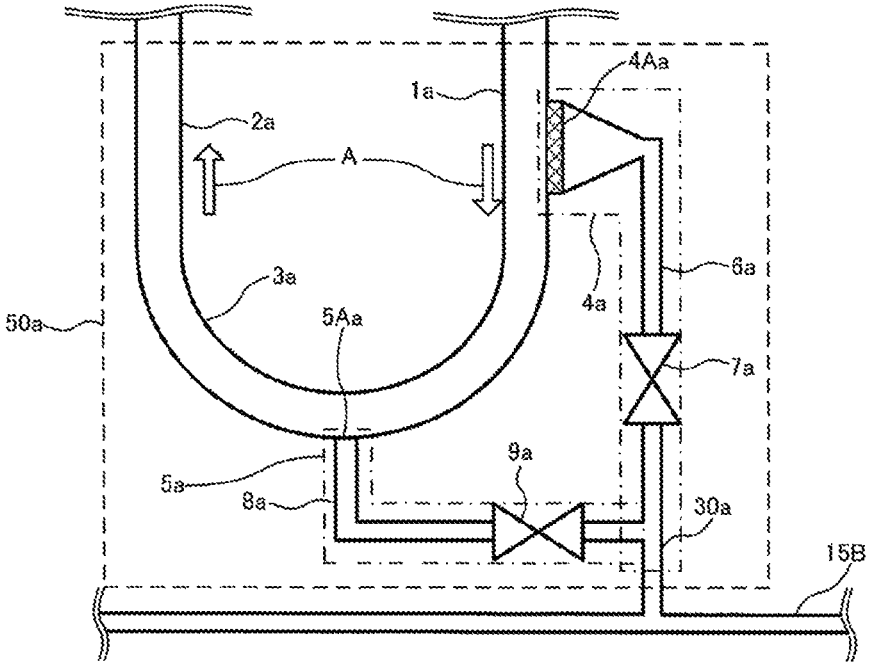
FIG. 4 is a schematic configuration diagram schematically illustrating an exemplary configuration of the oil separator of Embodiment 1 of the present disclosure.

FIG. 4 is a schematic configuration diagram schematically illustrating an exemplary configuration of an oil separator 50*a* of Embodiment 1 of the present disclosure. The oil separator 50*a* is Modification of the oil separator 50 and will be described below with reference to FIG. 4. The oil separator 50*a* is similar in fundamental configuration to the oil separator 50; however, the oil separator 50*a* is distinguished from the oil separator 50 by suffixing "a" to the reference sign of each constituent component in the oil separator 50*a*. In FIG. 4, the flow of the refrigerant is represented by arrows A. Further, similarly to the oil separator 50, the oil separator 50*a* is installed, as one of the constituent components of the refrigeration cycle apparatus 100, in the refrigeration cycle of the refrigeration cycle apparatus 100.

Similarly to the inflow pipe 1, an inflow pipe 1*a* is a pipe through which high-temperature and high-pressure refrigerant flows.

Similarly to the outflow pipe 2, an outflow pipe 2*a* is a pipe through which the high-temperature and high-pressure refrigerant flows.

A connection pipe 3*a* is similar in usage to the connection pipe 3 and different in shape from the connection pipe 3. The connection pipe 3*a* is a U-shaped pipe bent into a U shape. The connection pipe 3 exemplarily illustrated in FIG. 3 also has a bent shape.

A differential pressure generation mechanism 4*a* is configured to generate a differential pressure when the connection pipe 3*a* communicates with the suction pipe 15B, similarly to the differential pressure generation mechanism 4. However, the differential pressure generation mechanism 4*a* is bent in the refrigerant flow direction of a high pressure-low pressure connection pipe 6*a* and located to the inflow pipe 1*a* of the connection pipe 3*a*. That is, the differential pressure generation mechanism 4*a* is located at a part of a right side surface of the inflow pipe 1*a* in the drawing.

A filter portion 4Aa is configured to collect the lubricating oil that is in a form of mist and to form the collected lubricating oil into a liquid film, similarly to the filter portion 4A.

Similarly to the high pressure-low pressure connection pipe 6, the high pressure-low pressure connection pipe 6*a* has one end connected to the connection pipe 3*a* and the other end connected to the suction pipe 15B.

Similarly to the flow control valve 7, a flow control valve 7*a* is configured to adjust the refrigerant flow rate.

Similarly to the oil return mechanism 5, an oil return mechanism 5*a* is configured to return the lubricating oil separated by the differential pressure generation mechanism 4 to the suction port of the compressor 10.

Similarly to the oil return port 5A, an oil return port 5Aa is opened and formed at the outflow pipe 2*a* of the connection pipe 3*a*. The oil return port 5Aa is located lowermost in the connection pipe 3*a*. Therefore, the lubricating oil collected by the differential pressure generation mechanism 4*a* easily flows into an oil return circuit 8*a*.

Similarly to the oil return circuit 8, the oil return circuit 8*a* has one end connected to the connection pipe 3*a* and the other end connected to the suction pipe 15B.

An oil return valve 9*a* is located in the oil return circuit 8 and is configured to adjust the flow rate of lubricating oil by adjusting the opening degree and the closing degree of the oil return valve 9*a*.

Thus, even when the connection pipe 3*a* is used, the oil separator 50*a* exerts effects similar to the effects of the oil separator 50.

Similarly to FIG. 3, FIG. 4 illustrates a relay pipe 30*a* that is connected to the suction pipe 15B and is commonly used as a connection portion at which the high pressure-low pressure connection pipe 6*a* and the suction pipe 15B are connected and a connection portion at which the oil return circuit 8*a* and the suction pipe 15B are connected.

The actual location of the connection pipe 3*a* is not specified; however, it is desired that the connection pipe 3*a* is located, as illustrated in FIG. 4, in such a manner that the oil return port 5Aa is located lowermost in the connection pipe 3*a*.

<Exemplary Control of Flow Control Valve 7>

As described above, the opening degree and the closing degree of the flow control valve 7 are adjusted and are controlled by the controller 70. The controller 70 is configured to adjust the opening degree of the flow control valve 7 depending on an operation mode of the refrigeration cycle apparatus 100. Hereinafter, an exemplary case in which the refrigeration cycle apparatus 100 is used as an air-conditioning apparatus will be described.

For example, when the refrigeration cycle apparatus 100 is in an operation mode in which the differential pressure between a pressure of refrigerant close to the discharge port and a pressure of refrigerant close to the suction port of the compressor 10 is smaller than a reference value, the controller 70 sets the opening degree of the flow control valve 7 to be smaller than the reference value. This setting reduces the bypass amount of the refrigerant that flows in the high pressure-low pressure connection pipe 6. In the operation mode in which the differential pressure is smaller than the reference value, when the opening degree of the flow control valve 7 is set to be larger than the reference value, the flow rate of the refrigerant that circulates in the entire refrigerant circuit may decrease. Therefore, in view of such a case, the refrigeration cycle apparatus 100 is configured to control the opening degree of the flow control valve 7 depending on the operation mode, and the oil separation efficiency is thus improved with less deterioration in performance.

The operation mode in which the differential pressure between the pressure of refrigerant close to the discharge port and the pressure of refrigerant close to the suction port of the compressor 10 is smaller than the reference value is, for example, an operation mode in which the operation is stable in the cooling operation or the heating operation. In addition, the reference value is appropriately set in accordance with the intended use of the refrigeration cycle apparatus 100. The reference value may be set in advance or may be set later. Further, the reference value may be changeable.

<Exemplary Control of Oil Return Valve 9>

As described above, the opening degree and the closing degree of the oil return valve 9 are adjusted and are controlled by the controller 70. The controller 70 is configured to adjust the opening degree of the oil return valve 9 depending on the operation mode of the refrigeration cycle apparatus 100. Hereinafter, an exemplary case in which the refrigeration cycle apparatus 100 is used as an air-conditioning apparatus will be described.

For example, in an operation mode in which the compressor frequency of the refrigeration cycle apparatus 100 increases, the controller 70 sets the opening degree of the oil return valve 9 to be greater than the reference value. This setting increases the return amount of lubricating oil that flows in the oil return circuit 8. In the operation mode in which the compressor frequency increases, when the opening degree of the oil return valve 9 is set to be smaller than the reference value, the amount of lubricating oil returned to the compressor 10 may decrease. Therefore, in view of such a case, the refrigeration cycle apparatus 100 is configured to control the opening degree of the oil return valve 9 depending on the operation mode, and the oil separation efficiency is thus improved with less deterioration in performance.

The operation mode in which the compressor frequency increases is, for example, an operation mode when the compressor 10 is started.

Embodiment 2

Figure 5:
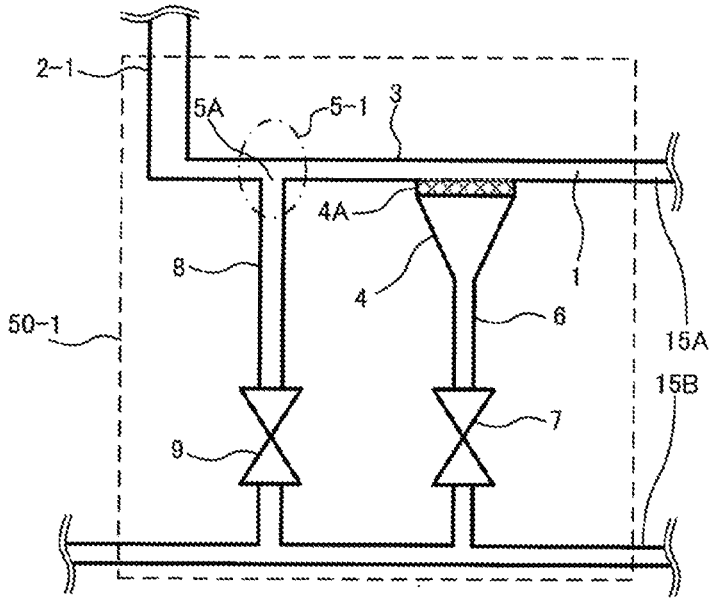
FIG. 5 is a schematic configuration diagram schematically illustrating an exemplary configuration of an oil separator of Embodiment 2 of the present disclosure.

FIG. 5 is a schematic configuration diagram schematically illustrating an exemplary configuration of an oil separator 50-1 of Embodiment 2 of the present disclosure. The oil separator 50-1 will be described with reference to FIG. 5. The oil separator 50-1 is similar in fundamental configuration to the oil separator 50 of Embodiment 1; however, each constituent component in the oil separator 50-1 that is different from the corresponding constituent component in the oil separator 50 is distinguished by suffixing "-1" to the reference sign of the constituent component in the oil separator 50-1. Similarly to the oil separator 50, the oil separator 50-1 is installed, as one of the constituent components of the refrigeration cycle apparatus 100, in the refrigeration cycle of the refrigeration cycle apparatus 100.

In Embodiment 2, differences from Embodiment 1 will be mainly described, and the same parts as the parts described in Embodiment 1 are denoted by the same reference signs and the redundant description of the same parts will not be repeated.

In the oil separator 50-1, the inflow pipe 1 and the outflow pipe 2-1 are differentiated in pipe diameter. This configuration improves the oil separation efficiency in the oil separator 50-1.

Specifically, the pipe diameter of the outflow pipe 2-1 and the pipe diameter of the inflow pipe 1 are set in such a manner that the flow rate in the outflow pipe 2-1 is less than or equal to a zero penetration flow rate for the lubricating oil. That is, a relationship "pipe diameter of inflow pipe 1<pipe diameter of outflow pipe 2-1" is satisfied. Further, the outflow pipe 2-1 is located vertically as illustrated in FIG. 5.

Operations of the oil separator 50-1 are similar to the operations of the oil separator 50 and the redundant description of the similar operations will not be repeated.

Here, the zero penetration flow rate will be described.

In a portion of the refrigerant circuit in which the gaseous refrigerant flows, the refrigerant and the lubricating oil exhibit a flow configuration of two-phase gas-liquid state. In particular, in the upward flow, the flow state of lubricating oil changes depending on a gas flow rate. When the gas flow rate increases, the gas flow causes the liquid to rise together with the gas flow. When the gas flow rate decreases, the liquid falls along the tube wall. The state in which the gas flow rate increases and the falling liquid film decreases is referred to as the zero penetration and the flow rate at that time is referred to as the zero penetration flow rate.

That is, in the oil separator 50-1, the pipe diameter of the outflow pipe 2-1 is set in such a manner that the flow rate in the outflow pipe 2-1 is less than or equal to the zero penetration flow rate for the lubricating oil and the outflow pipe 2-1 is vertically located, to thereby reduce the lubricating oil that rises in the outflow pipe 2-1 against its own weight.

The zero penetration flow rate is calculated, using a well-known formula, on the basis of the pipe diameter and the state of gas-liquid refrigerant.

As described above, in the oil separator 50-1, the pipe diameter of the outflow pipe 2-1 is set in such a manner that a flow rate in the outflow pipe 2-1 is less than or equal to the zero penetration flow rate for the lubricating oil, and the outflow pipe 2-1 is vertically located. This configuration reduces the amount of lubricating oil that flows out through the outflow pipe 2-1 to the outside of the oil separator 50-1 even when the refrigerant flow rate is high. Therefore, with the oil separator 50-1, when the lubricating oil collected by the differential pressure generation mechanism 4 is returned through the oil return mechanism 5, the amount of lubricating oil that is brought out through the outflow pipe 2-1 is reduced, and accordingly the oil separation efficiency is improved.

Embodiment 3

Figure 6:
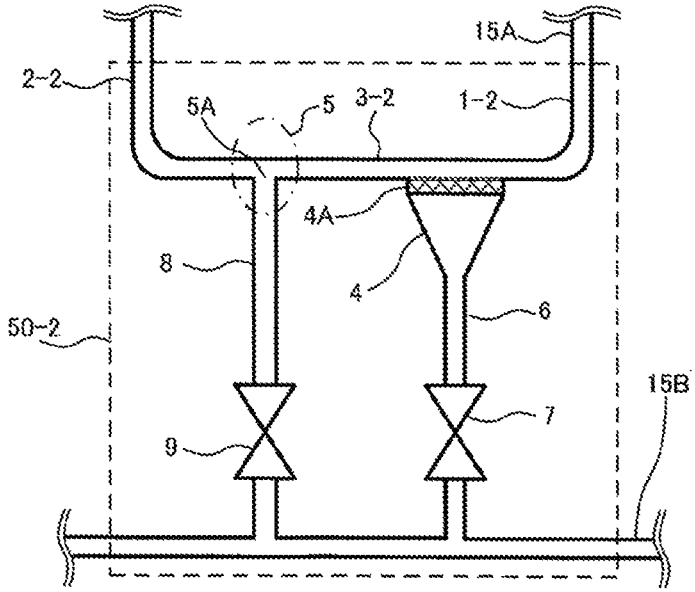
FIG. 6 is a schematic configuration diagram schematically illustrating an exemplary configuration of an oil separator of Embodiment 3 of the present disclosure.

FIG. 6 is a schematic configuration diagram schematically illustrating an exemplary configuration of an oil separator 50-2 of Embodiment 3 of the present disclosure. The oil separator 50-2 will be described with reference to FIG. 6. The oil separator 50-2 is similar in fundamental configuration to the oil separator 50 of Embodiment 1; however, each constituent component in the oil separator 50-2 that is different from the corresponding constituent component in the oil separator 50 is distinguished by suffixing "-2" to the reference sign of the constituent component in the oil separator 50-2. Similarly to the oil separator 50, the oil separator 50-2 is installed, as one of the constituent components of the refrigeration cycle apparatus 100, in the refrigeration cycle of the refrigeration cycle apparatus 100.

In Embodiment 3, differences from Embodiments 1 and 2 will be mainly described, and the same parts as the parts described in Embodiments 1 and 2 are denoted by the same reference signs and the redundant description of the same parts will not be repeated.

In the oil separator 50-2, the shape of a connection pipe 3-2 is different from the shape of the connection pipe 3. This configuration improves the oil separation efficiency in the oil separator 50-2.

Specifically, the connection pipe 3-2 is a curved pipe. The curved pipe is, for example, a U-shaped pipe or an L-shaped pipe. One end of the connection pipe 3-2 is used as an inflow pipe 1-2 that extends in the vertical direction, and the other end of the connection pipe 3-2 is used as an outflow pipe 2-2 that extends in the vertical direction.

Operations of the oil separator 50-2 are similar to the operations of the oil separator 50 and the redundant description of the similar operations will not be repeated.

As described above, in the oil separator 50-2, the connection pipe 3-2 is a curved pipe. This configuration promotes the gravity separation action and the centrifugal force separation action in a portion that extends from the inflow pipe 1-2 to the outflow pipe 2-2. That is, in the oil separator 50-2, as the connection pipe 3-2 includes a part curved in the direction of gravity, the gravity separation action that uses the own weight of lubricating oil is promoted. Further, in the oil separator 50-2, as the connection pipe 3-2 includes at least two bent portions, the centrifugal force separation action that uses the centrifugal force that generates when the lubricating oil changes the flow direction is promoted. Therefore, with the oil separator 50-2, when the lubricating oil collected by the differential pressure generation mechanism 4 is returned through the oil return mechanism 5, the amount of lubricating oil that is brought out through the outflow pipe 2-2 is reduced, and accordingly the oil separation efficiency is improved.

Embodiment 4

Figure 7:
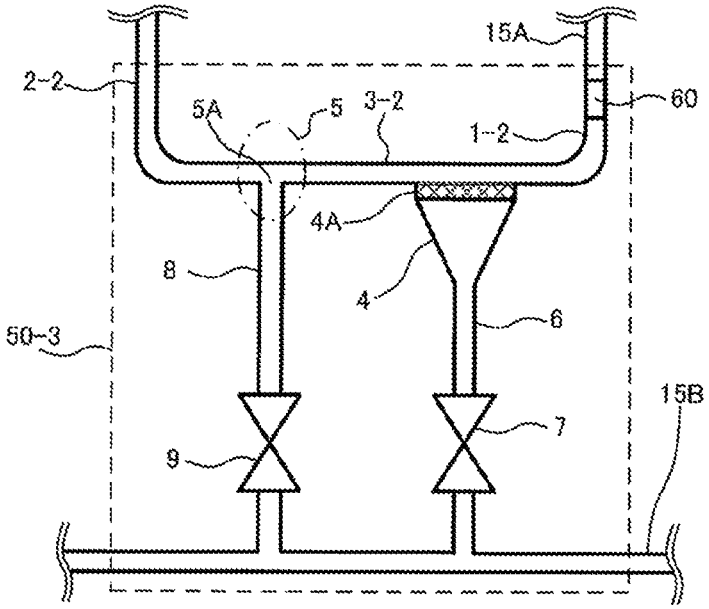
FIG. 7 is a schematic configuration diagram schematically illustrating an exemplary configuration of an oil separator of Embodiment 4 of the present disclosure.

FIG. 7 is a schematic configuration diagram schematically illustrating an exemplary configuration of an oil separator 50-3 of Embodiment 4 of the present disclosure. The oil separator 50-3 will be described with reference to FIG. 7. The oil separator 50-3 is similar in fundamental configuration to the oil separator 50 of Embodiment 1. Similarly to the oil separator 50, the oil separator 50-3 is installed, as one of the constituent components of the refrigeration cycle apparatus 100, in the refrigeration cycle of the refrigeration cycle apparatus 100. The oil separator 50-3 includes an inflow pipe 1-2, an outflow pipe 2-2, and a connection pipe 3-2, which are the same as the corresponding constituent components of Embodiment 3 and accordingly denoted by the same reference signs.

In Embodiment 4, differences from Embodiments 1 to 3 will be mainly described, and the same parts as the parts described in Embodiments 1 to 3 are denoted by the same reference signs and the redundant description of the same parts will not be repeated.

In the oil separator 50-3, a flow rectifier 60 is installed in the inflow pipe 1-2, that is, upstream of the differential pressure generation mechanism 4. This configuration improves the oil separation efficiency in the oil separator 50-3.

Specifically, the flow rectifier 60 such as a strainer is installed in the inflow pipe 1-2. The strainer is a net-like device for removing foreign substances such as solid components included in the refrigerant and the lubricating oil.

Operations of the oil separator 50-3 are similar to the operations of the oil separator 50 and the redundant description of the similar operations will not be repeated.

As described above, in the oil separator 50-3, the flow rectifier 60 is installed upstream of the differential pressure generation mechanism 4. This configuration removes foreign substances from the refrigerant and the lubricating oil that flows in the inflow pipe 1-2 and prevents the filter portion 4A from clogging. Therefore, the oil separator 50-3 is configured to prevent deterioration in performance of the differential pressure generation mechanism 4. The amount of lubricating oil that is brought out through the outflow pipe 2-2 is thus reduced, and accordingly the oil separation efficiency is improved.

Four embodiments of the oil separator of the present disclosure have been described; however, the oil separator is not limited to these embodiments and is changed or modified in various manners as long as the configuration of the oil separator does not depart from the scope and spirit of the present disclosure. Further, the oil separator may be formed by appropriately combining the contents of some embodiments. For example, the flow rectifier 60 described in Embodiment 4 may be applied to the oil separator of any one of Embodiments 1 to 3. Further, the pipe diameter described in Embodiment 2 may be applied to the oil separator of Embodiments 1, 3, and 4.

The refrigeration cycle apparatus 100 described in each embodiment is used as, for example, an air-conditioning apparatus, a heat pump water heater, or a showcase. Further, the refrigerant circuit configuration of the refrigeration cycle apparatus 100 is not limited to the refrigerant circuit configuration illustrated in FIG. 1.

REFERENCE SIGNS LIST

1 inflow pipe 1-2 inflow pipe 1*a* inflow pipe 2 outflow pipe 2-1 outflow pipe 2-2 outflow pipe 2*a* outflow pipe 3 connection pipe 3-2 connection pipe 3*a* connection pipe 4 differential pressure generation mechanism 4A filter portion 4Aa filter portion 4*a* differential pressure generation mechanism 5 oil return mechanism 5A oil return port 5Aa oil return port 5*a* oil return mechanism 6 high pressure-low pressure connection pipe

6*a* high pressure-low pressure connection pipe 7 flow control valve 7*a* flow control valve 8 oil return circuit 8*a* oil return circuit 9 oil return valve 9*a* oil return valve 10 compressor 11 flow switching device 12 first heat exchanger 13 decompression device 14 second heat exchanger 15 refrigerant pipe 15A discharge pipe 15B suction pipe 30 relay pipe

30*a* relay pipe 50 oil separator 50-1 oil separator 50-2 oil separator 50-3 oil separator 50*a* oil separator 60 flow rectifier 70 controller 100 refrigeration cycle apparatus O1 lubricating oil O2 lubricating oil R refrigerant

The invention claimed is:

1. An oil separator, comprising:

a first pipe connected to a discharge port of a compressor;

a second pipe connected to a suction port of the compressor;

a differential pressure generation mechanism that has a third pipe that connects the first pipe and the second pipe with each other and a filter portion located at a distal end of the third pipe at which the third pipe is connected to the first pipe, the differential pressure generation mechanism being configured to generate a differential pressure between a pressure of high-pressure refrigerant that flows in the first pipe and a pressure of low-pressure refrigerant that flows in the second pipe; and an oil return mechanism that has an oil return port opened and formed at the first pipe and disposed downstream of a connection position at which the third pipe is connected to the first pipe and a portion of an oil return circuit that connects the first pipe and the second pipe with each other via the oil return port, the oil return mechanism being configured to return, via the oil return port and the oil return circuit, lubricating oil included in the high-pressure refrigerant from the first pipe to the second pipe, the filter portion in the differential pressure generation mechanism being configured to collect, by the differential pressure, the lubricating oil that is in a form of mist included in the high-pressure refrigerant, and the first pipe allowing the collected lubricating oil to move downstream along an internal wall of the first pipe.

2. The oil separator of claim 1, wherein an outflow pipe positioned downstream in the first pipe is vertically located, and a pipe diameter of the outflow pipe and a pipe diameter of an inflow pipe positioned upstream in the first pipe are set in such a manner that a flow rate in the outflow pipe is less than or equal to a zero penetration flow rate for the lubricating oil.

3. The oil separator of claim 1, wherein the first pipe is a U-shaped pipe or an L-shaped pipe.

4. The oil separator of claim 3, wherein when the first pipe is the U-shaped pipe, the oil return port is located lowermost in the first pipe.

5. The oil separator of claim 1, wherein the filter portion is a demister.

6. The oil separator of claim 1, wherein a flow rectifier is located in the first pipe and upstream of the differential pressure generation mechanism.

7. The oil separator of claim 6, wherein the flow rectifier is a strainer.

8. A refrigeration cycle apparatus in which the oil separator of claim 1 is located downstream of the compressor.

9. The refrigeration cycle apparatus of claim 8, further comprising:

a flow control valve that is located in the third pipe of the oil separator and has an opening degree that is adjustable; and a controller configured to control the opening degree of the flow control valve, wherein the controller is configured to set the opening degree of the flow control valve to be smaller than a reference value, in an operation mode in which the differential pressure between a pressure of refrigerant close to the discharge port of the compressor and a pressure of refrigerant close to the suction port of the compressor is smaller than a reference value.

10. The refrigeration cycle apparatus of claim 8, further comprising:

an oil return valve that is located in the oil return circuit of the oil separator and has an opening degree that is adjustable; and a controller configured to control the opening degree of the oil return valve, wherein the controller is configured to set the opening degree of the oil return valve to be greater than a reference value, in an operation mode in which a frequency of the compressor increases.

* * * * *